US007299946B2

(12) United States Patent
Migliore

(10) Patent No.: US 7,299,946 B2
(45) Date of Patent: Nov. 27, 2007

(54) POUR SPOUT USED IN BOTTLES CONTAINING LIQUID SUBSTANCES WITH DIFFERENT DEGREES OF VISCOSITY

(75) Inventor: Juan Domingo Migliore, Buenos Aires (AR)

(73) Assignee: Alusud Argentina S.R.L., Buenos Aires (AR)

( * ) Notice: Subject to any disclaimer, the term of this patent is extended or adjusted under 35 U.S.C. 154(b) by 0 days.

(21) Appl. No.: 11/257,537

(22) Filed: Oct. 25, 2005

(65) Prior Publication Data

US 2006/0108382 A1 May 25, 2006

(30) Foreign Application Priority Data

Nov. 19, 2004 (AR) ..... P040104290

(51) Int. Cl.
*B67D 5/56* (2006.01)

(52) U.S. Cl. ..... 222/129; 222/482

(58) Field of Classification Search ..... 222/480, 222/482, 565, 129, 572, 144.5; 220/212.5, 220/832; 215/305
See application file for complete search history.

(56) References Cited

U.S. PATENT DOCUMENTS 3,417,897 A * 12/1968 Johnson ..... 220/254.3
4,881,668 A * 11/1989 Kitterman et al. ..... 222/482
4,893,729 A * 1/1990 Iggulden et al. ..... 222/144.5
4,955,513 A 9/1990 Bennett
5,048,730 A 9/1991 Forsyth et al.
5,251,774 A * 10/1993 Engle ..... 220/212.5
5,330,082 A * 7/1994 Forsyth ..... 222/480
5,579,932 A * 12/1996 Drozd et al. ..... 215/305
5,779,102 A * 7/1998 Smith ..... 222/144.5
5,799,838 A * 9/1998 Miller ..... 222/480
2004/0003489 A1 1/2004 McClean et al.

OTHER PUBLICATIONS

European Search Report in EP 05023288, which corresponds to the subject application.

* cited by examiner

*Primary Examiner*—Philippe Derakshani
(74) *Attorney, Agent, or Firm*—Wood, Phillips, Katz, Clark & Mortimer

(57) ABSTRACT

A pour spout used in bottles containing liquid substances with different degrees of viscosity. The pour spout comprises a pouring opening, which is defined by at least a first and a second pouring orifice for the liquid substances, being the pouring area of the first orifice bigger than or equal to the area of the pouring area of the second orifice. The use of the pour spout allows to obtain different flows of the contained liquid, according to the user's choice. Each orifice presents its respective lids, which are proportional to the orifice the cover. Alternatively, each orifice defines air inlet paths.

11 Claims, 2 Drawing Sheets

POUR SPOUT USED IN BOTTLES CONTAINING LIQUID SUBSTANCES WITH DIFFERENT DEGREES OF VISCOSITY

This invention relates to a pour spout used in bottles containing liquid substances with different degrees of viscosity, such as oils or vinegars. Preferably, the present invention relates to a pour spout to be used in containers such as bottles for oil pouring.

It is known the use of additives in different foods in order to prepare the most varied and delicious dishes. Among these additives, the most known and widely used is vegetal oil in all of its commercially available variations. As it is publicly known, oil has a high degree of viscosity, turning it into a substance very difficult to cleanse, and which also allows particles to adhere to any surface whereon such a substance is placed. For instance, in cases where the oil is bottled in tin containers, it is very common to see that the top of said container is normally impregnated with dust particles, and debris. The particle and debris must be removed and the top surface cleaned before and after its use, since the residue of drops after serving the product makes said particles to easily adhere to the surface. It should be clarified that this task of cleansing the top surface of the container is really cumbersome and that task should be carried out carefully enough to completely remove the substance.

Alternatively, plastic bottles are widely used as oil containers. These containers have a pour spout which generally has a cap that allows the container to be closed once it was opened. On the other hand, such pour spouts prevents, according to their special design, the dripping of droplets remaining at the edge of the spout. However, the main problem of these types of containers is that said pour spout does not offer a way to regulate the liquid flow coming through once the bottle is tilted in order to serve their content in the food. Therefore the flow had to be carefully regulated by the cook or person preparing such a dish, and in most of the cases it happens that the amount of oil poured into the dish is always greater than the necessary or required.

Thus, the present invention is aimed to provide a pour spout used in bottles containing liquid substances with different degrees of viscosity in order provide the possibility of pouring the necessary amount of liquid to be served.

This invention is also aimed to provide a pour spout used in bottles containing liquid substances with different degrees of viscosity that gives the possibility of using a single spout to alternatively serve at least two different flows.

Thus, this invention is aimed to provide a pour spout used in bottles containing liquid substances with different degrees of viscosity, where the pour spout consists of an outlet opening which is defined by at least a first and a second pouring orifice for the liquid substances, being the pouring area of the first orifice bigger than or equal to the pouring area of the second orifice.

Other objects, features and advantages of the invention will become apparent from a consideration of the following detailed description and the accompanying drawings.

Figure 1:
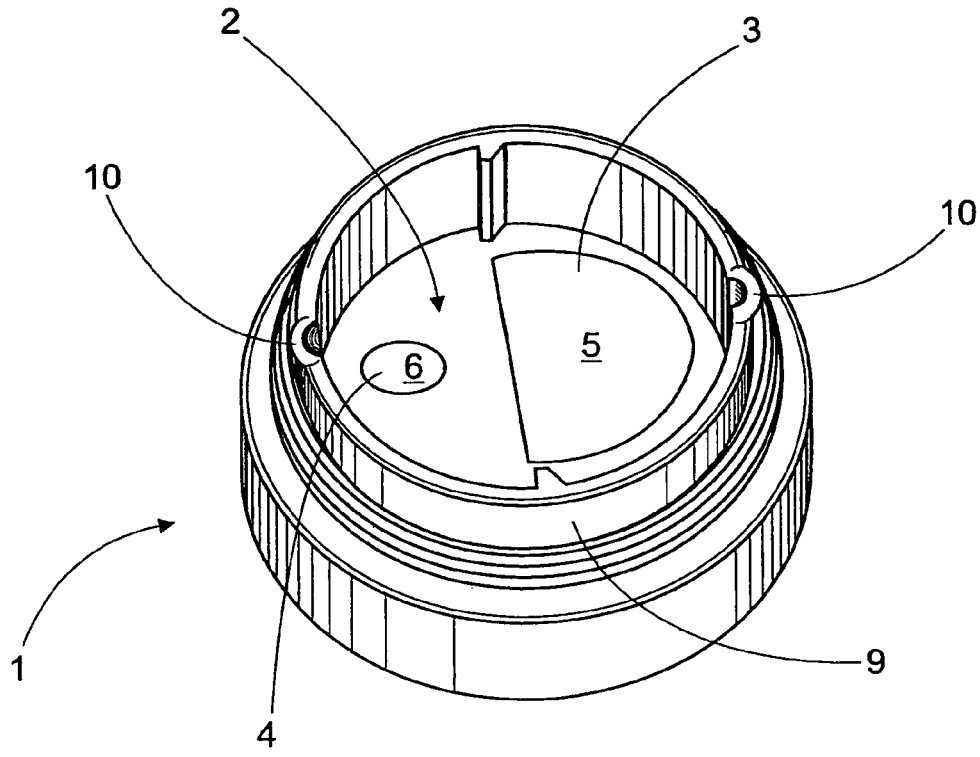
FIG. 1 is a top perspective view of the pour spout of this invention.

Referring to the figures, it is shown the pour spout 1 of this invention, which comprises an outlet opening 2 which is defined by at least a first orifice 3 and a second orifice 4. These orifices 3 and 4 define the pouring of the liquid substances held in the container (not illustrated) whereto this pour spout 1 is applied. In this particular embodiment, said orifices are arranged symmetrically facing each other for a better use of the features that the pour spout provides. However this arrangement of the orifices 3 and 4 should not be taken as a limitation of the scope of this invention. It should neither be taken as a limitation to the geometrical shaping of said orifices 3 and 4, since those illustrated by FIGS. 1 to 4 are shown only for illustration purposes.

Figure 2:
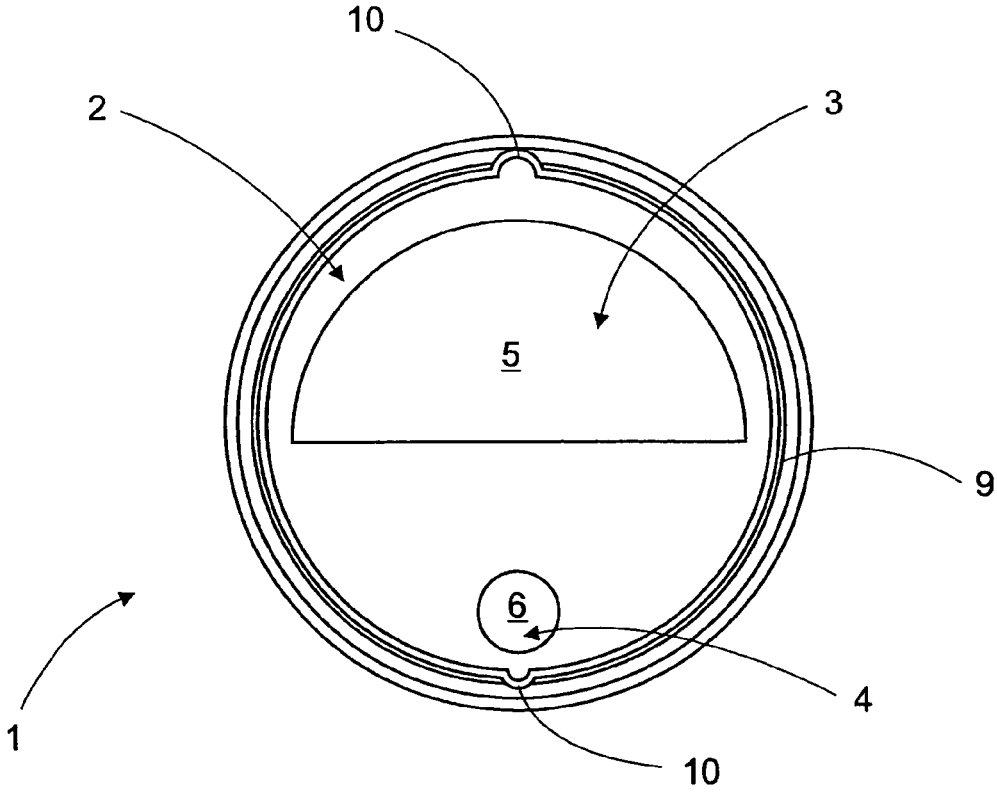
FIG. 2 is a top plant view of the cap in FIG. 1.

As it can be observed in FIGS. 1 and 2, the pouring area 5 of the first orifice 3 is, in this particular embodiment, bigger than the pouring area 6 of the second orifice 4. It is important to point out that even though it has been described that the pouring area 5 is bigger than the pouring area 6, it may not be so since it is possible that there could be no difference between said pouring areas 5 and 6, or even that the pouring area 6 is bigger than the pouring area 5, being these alternatives comprised in the scope and spirit of the present invention.

Alternatively, it is observed that from the pouring opening 2 a rim neck 9 projects defining a sort of pour spout that comprises two grooves 10 which define anti-dripping zones. As observed, each of said grooves 10 is strictly related to its corresponding orifice, allowing the liquid held in the container to be easily served and preventing the dripping of the remaining liquid in the pouring opening 2, once the content is already served.

Figure 3:
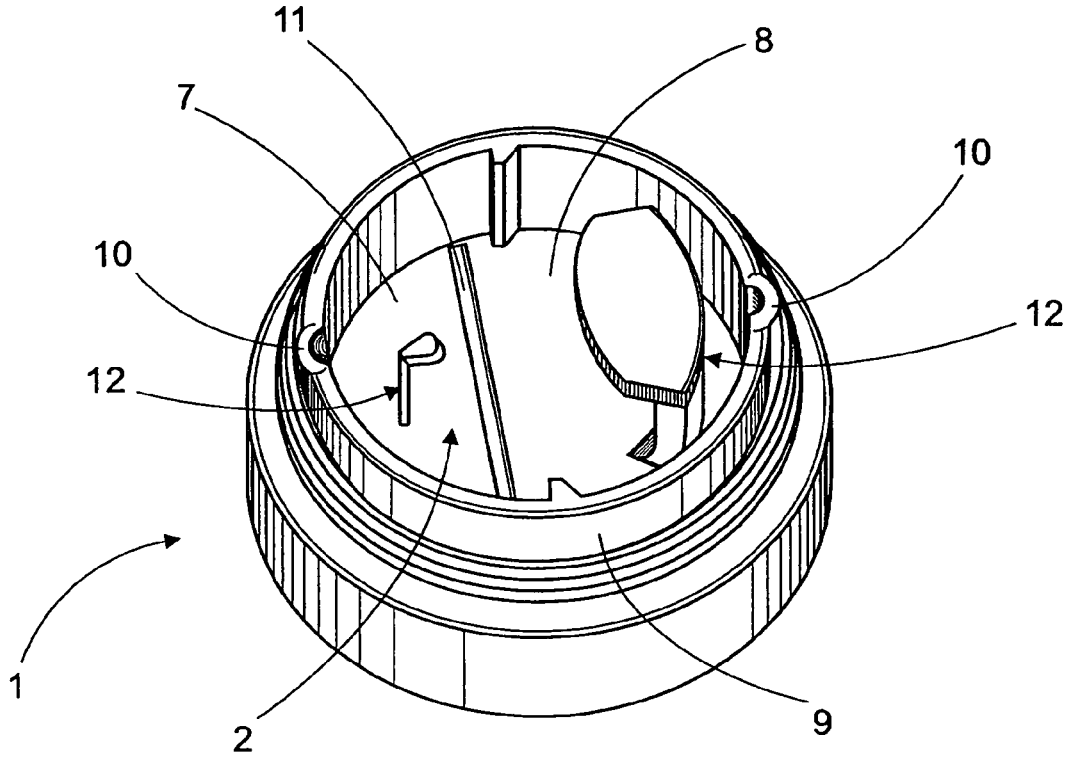
FIG. 3 is a top perspective view of the spout in FIG. 1.

Making reference to FIG. 3, it is possible to observe that the pouring opening is closed by lids 7 and 8. These lids 7 and 8 restrain the exit of the liquid through orifices 3 and 4. These lids are joined by a hinge 11 that allows them to pivot from an opened position to a closed position. On the other hand, each lid 7 and 8 presents a pulling portion 12 allowing the easy opening and closing of said lids 7 and 8. Furthermore, said portions 12 project perpendicularly from their respective lids. The end of said portions 12 comprises an "L" shaped flange. The portion of the L-shaped flange allows that when at least one of the lids are opened, this flange is retained by the rim of groove 10 preventing the lid to accidentally close again. The closing may only be made when a minor force is inflicted from portion 12 to unlock the corresponding lid. As anyone skilled in the art shall be able to note, the lids locking are effected only when one of them is opened and the other is completely closed.

Figure 4:
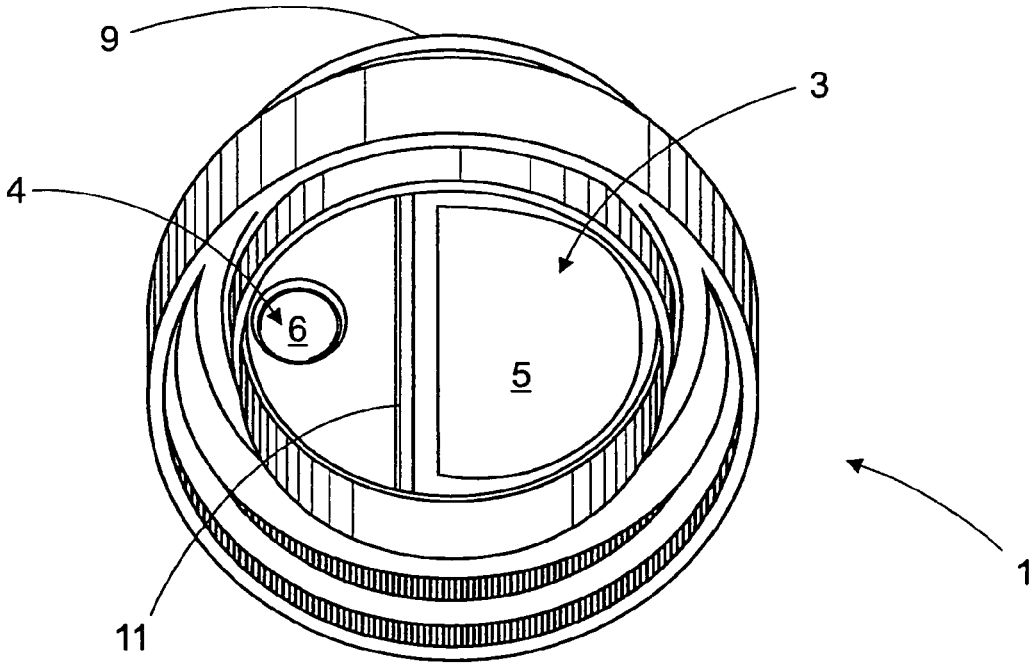
FIG. 4 is a bottom perspective view of the cap in FIG. 1.

Referring to FIG. 4, it can be observed the difference in the areas between orifices 3 and 4 mentioned before. Principally, the difference is given in order to obtain at least two different flows of the liquid to be served according to the needs, as it will be explained hereinbelow. However, said difference between the pouring areas also allows that at the time of using any of the orifices to serve the liquid contained, the remaining orifice may be used as a air inlet path, thus allowing the liquid flow pouring through the chosen orifice to be constant and without interruptions or unwanted gurgling.

Finally, it will be summarized an alternative use of the pour spout 1, object of this invention, by making reference to all of the figures mentioned above. Accordingly, the pour spout 1 is arranged on a container holding the liquid as a part of it and not as a mere accessory, that is, said spout replaces the spouts commonly found in the art. As it is shown in FIG. 3, the spout 1 is in its original state, where lids 7 and 8 are closed. When a person wishes to use the liquid contained (which can be any liquid with different degrees of viscosity, but preferably it is used for different types of oils), he/she shall choose the necessary liquid amount and the flow speed in which it must be served. That is, if the contained liquid is edible oil and the person needs a certain amount for the filling of a pot or saucepan to make a cooking of any sort, then the person shall choose the orifice 3 in order to obtain a larger flow and thus filling the pot faster. As it was previously mentioned, if the contained liquid, at the time of being served, starts gurgling, the user may open the second and smaller lid to allow air to flow through the orifice 4 into the interior of the container and to allow a continued and constant flow of the liquid.

On the other hand, if the person wishes to use a smaller liquid flow, it will only require to choose to open lid 12 corresponding to orifice 4, thus obtaining a reduced flow compared to the flow obtained by using orifice 3. As in the case of the previous paragraph, if the liquid flow starts gurgling or is slowly interrupted, the person shall only have to open lid 12 corresponding to orifice 3 in order to allow the air to enter into of the container. Additionally, it is important to note that it is not necessary to open each lid 7 or 8 to choose the desired flow, since lids 7 or 8 dimensions are proportional to the size of orifices 4 and 3 respectively.

I claim:

1. A pour spout used in bottles containing liquid substances with different degrees of viscosity, wherein said pour spout comprises a pouring opening defined by at least a first and a second orifice for the pouring of liquid substances, the pouring area of the second orifice being bigger than or equal to the pouring area of the first orifice, wherein said first and second orifices are provided with respective blocking lids for the pouring of contained liquid, wherein each of said lids is movable from a closed position by manipulation of a respective upwardly projecting pulling portion, said pour spout further comprising a rim neck projecting from said pouring opening, said pulling portions each comprising fastening means attachable to an edge of said rim neck.

2. The spout of claim 1, wherein the sizes of said lids are proportional to the sizes of the first and second orifices.

3. The spout of claim 1 or 2, wherein said first and second spouts are symmetrically arranged.

4. The spout of claim 1 or 2, wherein said first and second pouring orifices alternatively define an air inlet path.

5. The pour spout of claim 1, wherein said lids are opposing each other and joined by means of a hinge.

6. The pour spout of claim 1, including at least one retention portion for retaining at least one of said lids in an open position.

7. The pour spout of claim 1, wherein one or both of said lids are pivotal about a respective hinge axis.

8. A pour spout used in bottles containing liquid substances with different degrees of viscosity, wherein said pour spout comprises a pouring opening defined by at least a first and a second orifice for the pouring of liquid substances, the pouring area of the first orifice being bigger than or equal to the pouring area of the second orifice, wherein a rim neck that defines a spout projects from the pour opening, said rim neck comprising at least a pair of grooves arranged in a fashion that faces each of the first and second pouring orifices.

9. A pour spout used in bottles containing liquid substances with different degrees of viscosity, wherein said pour spout comprises a pouring opening defined by at least a first and a second orifice for the pouring of liquid substances, the pouring area of the second orifice being bigger than the pouring area of the first orifice, wherein said first and second orifices are provided with respective blocking lids for the pouring of contained liquid, wherein each of said lids is movable from a closed position by manipulation of a respective upwardly projecting pulling portion, said pour spout further comprising a rim neck projecting from said pouring opening, said blocking lid provided for said second orifice is pivoted about a respective hinge axis, said pour spout including a pair of projections which extend inwardly of said rim neck at respective sides of said hinge axis.

10. The spout of claim 9, wherein the sizes of said lids are proportional to the sizes of the first and second orifices.

11. The spout of claim 9, wherein said first and second spouts are symmetrically arranged.

* * * * *